United States Patent [19]

Ganser et al.

[11] Patent Number: 4,816,721

[45] Date of Patent: Mar. 28, 1989

[54] CIRCUIT ARRANGEMENT FOR OPERATING A HIGH-PRESSURE GAS DISCHARGE LAMP

[75] Inventors: Hans G. Ganser, Stolberg; Ralf Schäfer, Aachen; Hans P. Stormberg, Stolberg, all of Fed. Rep. of Germany

[73] Assignee: U.S. Philips Corp., New York, N.Y.

[21] Appl. No.: 555,226

[22] Filed: Nov. 25, 1983

[30] Foreign Application Priority Data

Dec. 11, 1982 [DE] Fed. Rep. of Germany ..... 3245924

[51] Int. Cl.[4] ..... H05B 37/00

[52] U.S. Cl. ..... 315/241 R; 315/200 R

[58] Field of Search ..... 315/205, 241 R, 238, 315/173, 176

[56] References Cited

U.S. PATENT DOCUMENTS

| | | | |
|---|---|---|---|
| 3,066,243 | 11/1962 | Mutschler | 315/241 R |
| 3,376,470 | 4/1968 | Stone et al. | 315/176 |
| 3,403,293 | 9/1968 | Michelsen | 315/176 |
| 3,780,342 | 12/1973 | Grimshaw et al. | 315/173 |
| 3,890,537 | 6/1975 | Park et al. | 315/209 R |
| 4,316,124 | 2/1982 | Verwimp et al. | 315/241 R |
| 4,350,933 | 9/1982 | Agarawalla et al. | 315/106 |
| 4,500,812 | 2/1985 | Roche | 315/173 |

*Primary Examiner*—David K. Moore

*Attorney, Agent, or Firm*—Bernard Franzblau

[57] ABSTRACT

A circuit arrangement for operating a high-pressure gas discharge lamp (3) with a pulsatory direct current produced from an alternating voltage supply (A, B) via a full-wave rectifier (1). The output of the full-wave rectifier is shunted by a series arrangement of a diode (4) and a capacitor (5). The capacitor (5) has a value of 10 nF to 1 μF and a resistor (6), which is high-ohmic with respect to a current limiter (2) in series with the lamp (3), is connected in a current circuit between the end of the capacitor facing the diode and the lamp (3). As a result, a low re-ignition voltage is attained during the head-up phase of the lamp.

20 Claims, 1 Drawing Sheet

CIRCUIT ARRANGEMENT FOR OPERATING A HIGH-PRESSURE GAS DISCHARGE LAMP

Figure 1:
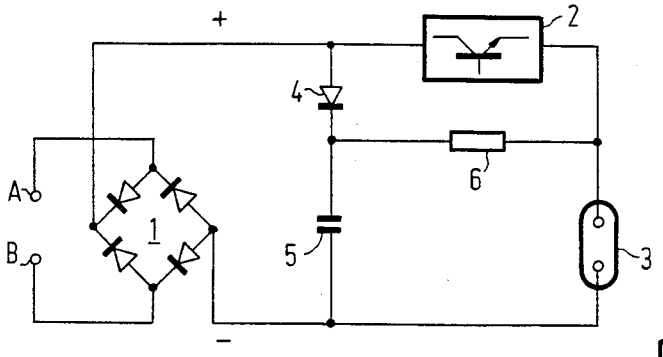

The invention relates to a circuit arrangement for operating a high-pressure gas discharge lamp with a pulsatory direct current, comprising a full-wave rectifier which is connected to an alternating voltage mains and supplies a direct voltage to the discharge lamp through a current limiter which is connected in series with it. The output of the full-wave rectifier is shunted by a series arrangement comprising a diode and a capacitor which, after each half period of the mains alternating voltage, is discharged at least in part through the lamp.

A problem in operating high-pressure gas discharge lamps is the primary ignition of the lamps, that is to say the starting of the cold lamps, and the reignition after each zero passage of the mains alternating current and each direct current pulse, respectively. This essentially holds for all high-pressure gas discharge lamps, for example, for mercury vapor- or sodium vapour gas discharge lamps. However, especially in metal halide discharge lamps, during the heating-up stage having a duration, depending upon the lamp size, from 30 seconds to 5 minutes after the primary ignition, such high re-ignition voltages may be required, for example, 500 to 1000V, that these voltages can no longer be supplied by the voltage source so that the lamp extinguishes. Nearly all of the elements of the circuit arrangement, such as, for example, switching transistors and capacitors, then have to be designed for this voltage.

In a circuit arrangement of this kind known from U.S. Pat. No. 4,316,124 comprising a series arrangement of a diode and a capacitor shunting the full-wave rectifier, the re-ignition of the lamp is improved in that the capacitor is discharged at least in part through the lamp after each half period of the mains alternating voltage, that is to say in the proximity of the zero passages of the mains alternating voltage, and via a thyristor. At the heating-up stage of metal halide lamps, a high voltage of about 200 to 300V is required at this capacitor for a period of about 1 msec before and after the zero passage of the mains alternating voltage to avoid re-ignition difficulties. In the known circuit arrangement, the capacitor for this purpose has a capacitance of 2.2 $\mu$F. Such a capacitor is comparatively voluminous and could be inserted only with difficulty into a circuit arrangement which has to be integrable, for example, in the lamp itself, for example, in the lamp cap.

The invention has for an object to provide a circuit arrangement for operating a high-pressure gas discharge lamp which makes it possible to operate with a low reignition voltage during the heating-up stage of the lamp and whose elements can be comparatively small.

According to the invention, this is achieved in a circuit arrangement of the kind mentioned in the opening paragraph in that the capacitor has a value of 10 nF to 1 $\mu$F and in that a resistor which is high-ohmic with respect to the current limiter is included in a current circuit between the end of this capacitor facing the diode and the lamp.

The invention is based on the insight that, in order to avoid re-ignition difficulties, it is sufficient if the discharge current circuit between the capacitor and lamp is traversed by a current which is very small as compared with the average lamp current and which, depending upon the lamp size, lies between 1 and 30 mA. This is achieved in that the current traversing the lamp is limited by the high-ohmic resistor. At the same time, a considerable discharge of the now comparatively small capacitor is then avoided. In the simplest case, the current limiter may be an ohmic resistor which is connected in series with a further diode. Advantageously, the high-ohmic resistor is connected via a switching transistor to the lamp, which leads to a reduction of the dissipation in the high-ohmic resistor.

However, the current limiter may alternatively be an electronic ballast unit, for example, a chopper, or a blocking or forward converter.

In an advantageous further embodiment of the circuit arrangement according to the invention, a further diode is connected in series in front of the electronic ballast unit and the end of the high-ohmic resistor facing the lamp is connected between this further diode and the ballast unit. A switching transistor usually connected in series with the lamp in such ballast units will conduct in the proximity of the zero passages of the mains alternating voltage so that a current from the capacitor can then flow to the lamp via the high-ohmic resistor.

Figure 2:
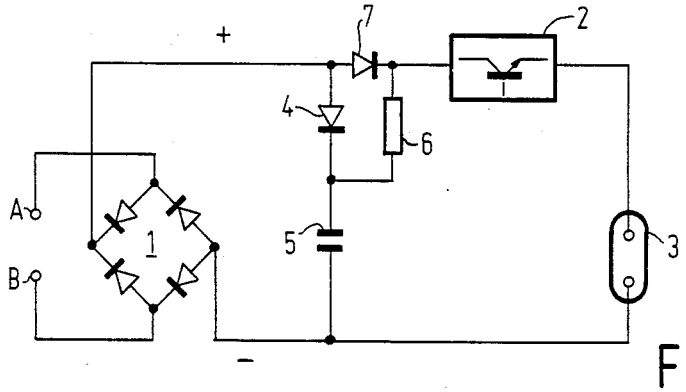
Figure 3:
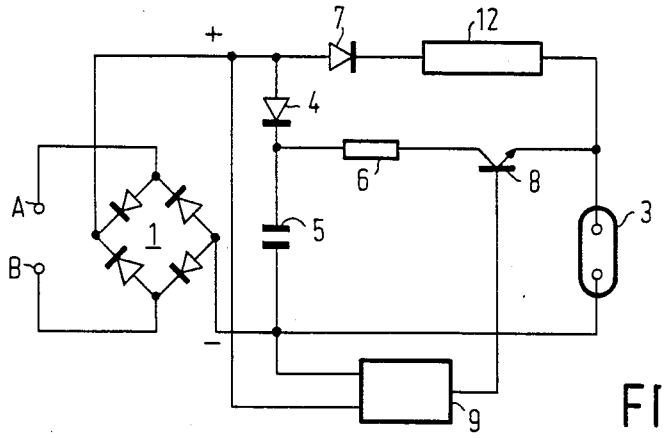

Some embodiments of the invention will now be described, by way of example, with reference to the accompanying drawing, in which:

FIG. 1 shows a circuit arrangement, for operating a high-pressure gas discharge lamp, comprising as a current limiter an electronic ballast unit, FIG. 2 shows a modified circuit arrangement of this kind, and FIG. 3 shows a circuit arrangement, for operating a high-pressure gas discharge lamp, having an ohmic resistor as a current limiter.

A and B designate input terminals for connection to an alternating voltage mains of 220V, 50 Hz. The input terminals A, B are connected to a full-wave rectifier 1, if necessary via a mains filter (not shown). The rectifier 1 comprises four diodes and produces a pulsatory direct current. A high-pressure gas discharge lamp 3, especially a metal halide discharge lamp, is connected in series with a current limiter 2 to the output of the full-wave rectifier 1. The current limiter 2 is in this case an electronic ballast unit, as described, for example, in U.S. Pat. No. 3,890,537. The output of the full-wave rectifier 1 is moreover shunted by a series arrangement of a diode 4 and a capacitor 5. Between the end of the capacitor 5 facing the diode and the lamp 3 a resistor 6 is connected which is high-ohmic with respect to the current limiter 2.

After the primary ignition of the lamp 3, the latter goes through a heating-up stage which, depending upon the lamp size, has a duration between about 30 seconds and 5 minutes. During this heating-up stage, comparatively high reignition voltages are required after each zero passage of the mains alternating voltage in order that the lamp does not extinguish. However, these high re-ignition voltages normally cannot be supplied by the electronic ballast unit 2 after the zero passage of the mains alternating voltage. The capacitor 5 is rather provided for this purpose, which capacitor is charged during the peaks of the mains alternating voltage periods and is at least partly discharged near the zero passages of the mains alternating voltage via the lamp 3. If the capacitor 5 were connected directly to the lamp 3, discharge currents of more than 100 mA would flow. For a discharge current of sufficient duration this would require a very large capacitor. Due to the high-ohmic resistor 6, these currents from the capacitor 5 are reduced, depending upon the lamp size, to 1 to 30 mA. It is a surprise to find that this discharge current, which is very small as compared with the average lamp current, is sufficient during the zero passage of the mains alternating voltage to reignite the lamp 3 during its heting-up stage with a comparatively low voltage. For this purpose, the capacitor 5 needs to have a capacitance of only 10 nF to 1 μF. In a practical embodiment comprising a metal halide discharge lamp of 45W, the capacitor 5 had a capacitance of 200 nF and the resistor 6 had a value of 300 kΩ. The capacitor 5 is charged via the diode 4 to the peak value of the mains alternating voltage (about 300V). At the zero passage of the mains alternating voltage, a current of about 1 mA flows from the capacitor 5 via the resistor 6 through the lamp 3. In this case, the capacitor 5 is not discharged completely. With this circuit arrangement, the metal halide lamp of 45W passes through its heating-up stage without reignition problems.

In the circuit arrangement of FIG. 2, a further diode 7 is arranged in front of the electronic ballast unit 2 and the end of the high-ohmic resistor 6 facing the lamp is connected between this further diode 7 and the ballast unit 2. Also in this case, the high-ohmic resistor 6 contributes to the reduction of the discharge current from the capacitor 5 via the ballast unit 2 through the lamp 3 during the zero passages of the mains alternating voltage. The further diode 7 prevents a return current from flowing from the capacitor 5 to the full-wave rectifier 1.

If the electronic ballast unit 2 is, for example, a forward converter, the switching transistor of this converter is switched to the conductive state near the zero passages of the mains alternating voltage, so that during this time a current can flow from the capacitor 5 via the high-ohmic resistor 6 directly to the lamp 3. Outside the zero passages of the mains alternating voltage, the switching transistor of the electronic ballast unit 2 usually operates only with a duty cycle of about 30%, so that the current from the capacitor 5 via the high-ohmic resistor 6 is likewise interrupted with this duty cycle. Correspondingly, the dissipation in the high-ohmic resistor 6 is reduced to 30% which, however, does not adversely affect the ignition behaviour of the lamp 3 because the additional current from the capacitor 5 has to flow through the lamp 3 only in the proximity of the zero passages of the mains alternating voltage.

In contrast with the circuit arrangement of FIG. 1, the circuit of FIG. 3 uses an ohmic resistor 12 of about 250 ohms as the current limiter for the lamp 3. This resistor is connected in series with the further diode 7 in order to prevent return currents from flowing. The high-ohmic resistor 6 is connected via a switching transistor 8 to the lamp 3. This switching transistor 8 is switched on and off via a control circuit 9. The control circuit 9 is controlled by the rectified mains voltage. When the instantaneous value of this rectified mains voltage, in the proximity of the zero passages of the mains alternating voltage, falls below a value of, for example, 50V, the switching transistor 8 is switched on so that an additional current can flow from the capacitor 5 via the high-ohmic resistor 6 thorugh the lamp 3. At instantaneous values of the rectified mains voltage of more than, for example, 50V, that is to say during the major part of the period of the mains alternating voltage, the switching transistor 8 is maintained by the control circuit 9 in the non-conductive state so that the current through the high-ohmic resistor 6 is interrupted. Thus, dissipations occur in the high-ohmic resistor 6 only during about 10% of the mains alternating voltage period. The dissipation in the high-ohmic resistor 6 in this circuit arrangement usually lies below 0.1W for a metal halide discharge lamp of 45W.

What is claimed is:

1. A circuit arrangement for operating a high-pressure gas discharge lamp with a pulsatory direct current comprising, a full-wave rectifier connected to an alternating voltage supply, means for supplying a pulsatory direct voltage from the full-wave rectifier to the discharge lamp comprising a current limiter connected in series with the lamp across the full-wave rectifier, means for shunting the output of the full-wave rectifier by a series arrangement comprising a diode and a capacitor, said capacitor, in each half period of the alternating voltage, being discharged at least in part via the lamp, characterized in that the capacitor has a value of 10 nF to 1 μF, and a resistor, which is high-ohmic with respect to the current limiter, is connected in a current circuit between a junction point of the capacitor and the diode and a terminal of the lamp.

2. A circuit arrangement as claimed in claim 1, wherein the current limiter comprises an ohmic resistor connected in series with a further diode.

3. A circuit arrangement as claimed in claim 1, wherein the current limiter comprises an electronic ballast unit and the current circuit bypasses the current limiter and discharges the capacitor through the high-ohmic resistor such that substantially all of the capacitor discharge current flows through the high-ohmic resistor to the lamp.

4. A circuit arrangement as claimed in claim 1, wherein the high-ohmic resistor is connected to the lamp via the emitter-collector path of a switching transistor.

5. A circuit arrangement as claimed in claim 1 wherein the current limiter comprises an electronic ballast unit and a further diode is connected in series in front of the electronic ballast unit, and the end of the high-ohmic resistor facing the lamp is connected to a circuit point between said further diode and the ballast unit.

6. A circuit arrangement as claimed in claim 2, wherein the current circuit includes the high-ohmic resistor connected to the lamp via a series-connected switching transistor.

7. A circuit for operating a high-pressure discharge lamp from a pair of input terminals that supply a pulsatory direct voltage derived from a source of AC supply voltage comprising, a current limiter, means for connecting the current limiter in series with the discharge lamp across said pair of input terminals, means connecting a series arrangement of a diode and capacitor across said pair of input terminals, a resistor which is high-ohmic with respect to said current limiter, second means for connecting said high-ohmic resistor in a discharge current circuit for the capacitor that includes the discharge lamp whereby the capacitor is at least partly discharged in each half period of the AC supply voltage via the high-ohmic resistor and the lamp, the value of the resistance of the high-ohmic resistor limiting the capacitor discharge current to a maximum value of 30 ma.

8. A circuit as claimed in claim 7 wherein the capacitor has a capacitance value of at most 1 μF.

9. A circuit as claimed in claim 7 wherein the capacitor has a capacitance value of approximately 200 nF.

10. A circuit as claimed in claim 7 wherein the high-ohmic resistor is directly connected between one terminal of the lamp and an end of the capacitor facing the diode and wherein at least a part of the capacitor discharge occurs in the vicinity of the zero passages of the AC supply voltage.

11. A circuit as claimed in claim 7 wherein the current limiter comprises a resistor connected in series with a further diode between one input terminal and one terminal of the discharge lamp and the high-ohmic resistor is connected between said one terminal of the lamp and an end of the capacitor facing the diode.

12. A circuit as claimed in claim 7 wherein said high-ohmic resistor is connected between the capacitor and the lamp via a switching transistor, said circuit further comprising a control circuit responsive to the pulsatory direct voltage at the input terminals for supplying a control signal to a control electrode of the switching transistor so as to make the switching transistor conductive in the vicinity of the zero passages of the AC supply voltage.

13. A circuit as claimed in claim 7 wherein said high-ohmic resistor is connected between the capacitor and the lamp via a switching transistor.

14. A circuit as claimed in claim 13 wherein the switching transistor comprises said current limiter and further comprising a further diode connected between one input terminal and the switching transistor, and wherein the high-ohmic resistor is connected between the capacitor and a circuit junction point between the further diode and the switching transistor.

15. A circuit as claimed in claim 7 wherein the current limiter comprises a switching transistor connected between one input terminal and one terminal of the discharge lamp and the diode and high-ohmic resistor are further connected to form a series circuit in shunt with the switching transistor.

16. A circuit for operating a high-pressure discharge lamp from a pair of input terminals that supply a pulsatory direct voltage derived from a source of AC supply voltage comprising, a current limiter, means for connecting the current limiter in series with the discharge lamp across said pair of input terminals, means connecting a series arrangement of a diode and capacitor across said pair of input terminals, a resistor connected in a discharge current circuit for the capacitor that includes the discharge lamp whereby the capacitor is only partly discharged in each half period of the AC supply voltage via the resistor and the lamp, the values of the capacitor, the resistor and the current limiter being chosen so that the maximum capacitor discharge current is very small compared with the average value of the lamp operating current supplied from the input terminals via the current limiter.

17. A circuit as claimed in claim 16 wherein the circuit is intended to operate a 45 watt metal halide discharge lamp and the capacitor has a capacitance value of approximately 200 nF.

18. A circuit as claimed in claim 16 wherein the resistance value of the resistor limits the capacitor discharge current through the lamp to approximately 1 ma.

19. A circuit as claimed in claim 16 wherein the resistance value of the resistor is chosen to limit the capacitor discharge current through the lamp to a range of values between approximately 1 ma and approximately 30 ma, said range of values being sufficient to reignite the lamp subsequent to primary ignition of the lamp and during zero passages of the pulsatory direct voltage.

20. A circuit as claimed in claim 13 further comprising a control circuit coupled to the input terminals for supplying a control signal to a control electrode of the switching transistor so as to make the switching transistor conductive in the vicinity of the zero passages of the AC supply voltage and non-conductive throughout the remainder of each cycle of the AC supply voltage.

* * * * *